US008870631B2

(12) United States Patent
Tai

(10) Patent No.: US 8,870,631 B2
(45) Date of Patent: Oct. 28, 2014

(54) DRIVE ASSEMBLY FOR A GRINDER

(75) Inventor: Ming-Tsung Tai, Kaohsiung (TW)

(73) Assignee: CHA Enterprise Co., Ltd., Kaohsiung (TW)

( * ) Notice: Subject to any disclaimer, the term of this patent is extended or adjusted under 35 U.S.C. 154(b) by 656 days.

(21) Appl. No.: 13/215,532

(22) Filed: Aug. 23, 2011

(65) Prior Publication Data

US 2013/0052915 A1 Feb. 28, 2013

(51) Int. Cl.

| | |
|---|---|
| ***B24B 23/02*** | (2006.01) |
| ***B24B 47/12*** | (2006.01) |
| ***B24B 7/18*** | (2006.01) |

(52) U.S. Cl.

CPC ..... *B24B 47/12* (2013.01); *B24B 7/186* (2013.01)

USPC ..... 451/559; 451/271; 451/353

(58) Field of Classification Search

CPC ..... B24B 47/12; B24B 23/03; B24B 7/186; B24B 41/047; A47L 11/16; A47L 11/4069; A47L 11/18; F16H 7/02

USPC ..... 15/49.1, 98; 451/211, 271, 350, 352, 451/353; 474/87, 88

See application file for complete search history.

(56) References Cited

U.S. PATENT DOCUMENTS

| | | | | |
|---|---|---|---|---|
| 1,473,778 | A * | 11/1923 | Barry | 15/49.1 |
| 2,668,968 | A * | 2/1954 | Dobrowolski | 15/28 |
| 4,097,950 | A * | 7/1978 | Satterfield | 15/49.1 |
| 5,070,656 | A * | 12/1991 | Brogden | 451/353 |
| 6,540,596 | B1 * | 4/2003 | Van Der Veen | 451/350 |
| 7,241,210 | B2 * | 7/2007 | Van Vliet | 451/353 |
| 7,261,623 | B1 | 8/2007 | Palushi | |
| 7,563,156 | B2 * | 7/2009 | Anderson | 451/353 |
| 8,342,914 | B2 * | 1/2013 | Thysell | 451/353 |
| 8,366,517 | B2 * | 2/2013 | Weder | 451/353 |
| 2006/0026781 | A1 | 2/2006 | Van Vliet | |

FOREIGN PATENT DOCUMENTS

| | | | |
|---|---|---|---|
| DE | 202007010059 | U1 | 11/2007 |
| EP | 1970160 | A1 | 9/2008 |

* cited by examiner

*Primary Examiner* — Timothy V Eley
(74) *Attorney, Agent, or Firm* — patenttm.us

(57) ABSTRACT

A drive assembly for a grinder has a housing device, a drive device, multiple transmission devices and multiple grinding devices. The drive device has a motor, a driving wheel and a driving band connected with the motor and the driving wheel. Each transmission device has a transmission wheel, multiple driven wheels and a transmission band. Each transmission band is engaged with the driven wheels and the transmission wheel is engaged with the driving band. With two-layer arrangement of the bands, the driving band and the transmission bands are not long and can be rotated smoothly to reduce energy waste. Accordingly, the motor's load is greatly reduced, and life spans of the driving band and the transmission bands are prolonged.

15 Claims, 10 Drawing Sheets

DRIVE ASSEMBLY FOR A GRINDER

BACKGROUND OF THE INVENTION

1. Field of the Invention

The present invention relates to a drive assembly for a grinder, and more particularly to a drive assembly for a grinder to reduce a motor's load.

2. Description of Related Art

A conventional drive assembly for a grinder has a motor, a driving wheel, multiple driven wheels and a belt. The motor has a rotating shaft. The driving wheel is securely mounted around the shaft of the motor. The belt is engaged with the driving wheel and the driven wheels. When the shaft is rotated, the driven wheels are also rotated via the belt to proceed grinding.

However, the belt needs to be long enough so that the belt can be connected with all of the driven wheels. The long belt does not rotate smoothly and causes energy waste. Consequently, the motor's load increases and the belt is also easily worn.

To overcome the shortcomings, the present invention tends to provide a drive assembly for a grinder to mitigate the aforementioned problems.

SUMMARY OF THE INVENTION

The main objective of the invention is to provide a drive assembly for a grinder to reduce a motor's load.

A drive assembly for a grinder has a housing device, a drive device, multiple transmission devices and multiple grinding devices. The drive device has a motor, a driving wheel and a driving band connected with the motor and the driving wheel. Each transmission device has a transmission wheel, multiple driven wheels and a transmission band. Each transmission band is engaged with the driven wheels and the transmission wheel is engaged with the driving band. With two-layers arrangement of the bands, the driving band and the transmission bands are not long and can be rotated smoothly to reduce energy waste. Accordingly, the motor's load is greatly reduced, and life spans of the driving band and the transmission bands are prolonged.

Other objects, advantages and novel features of the invention will become more apparent from the following detailed description when taken in conjunction with the accompanying drawings.

DETAILED DESCRIPTION OF PREFERRED EMBODIMENT

Figure 1:
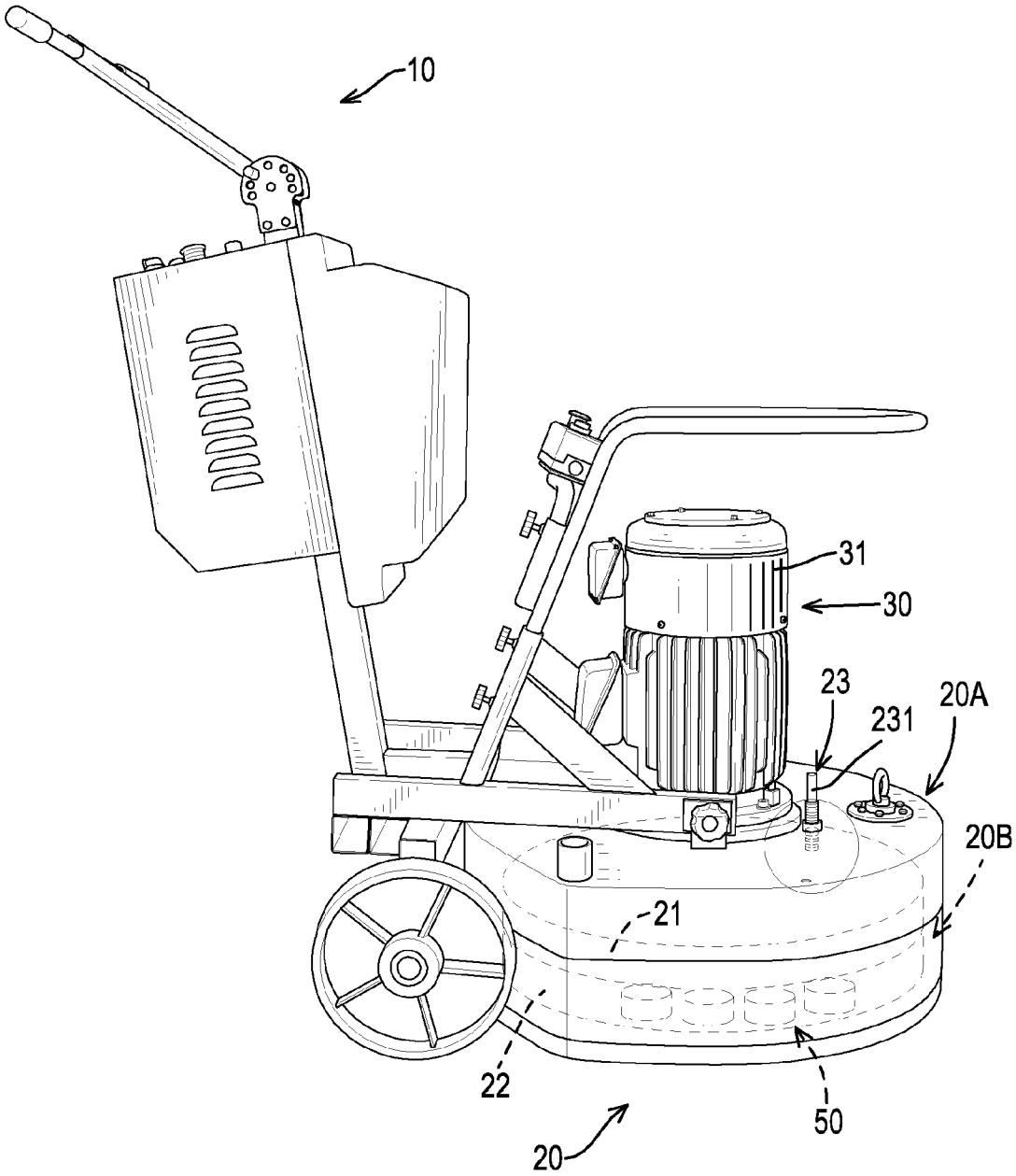
FIG. 1 is a perspective view of a first embodiment of a drive assembly for a grinder in accordance with the present invention, showing the drive assembly is mounted on a body.
Figure 2:
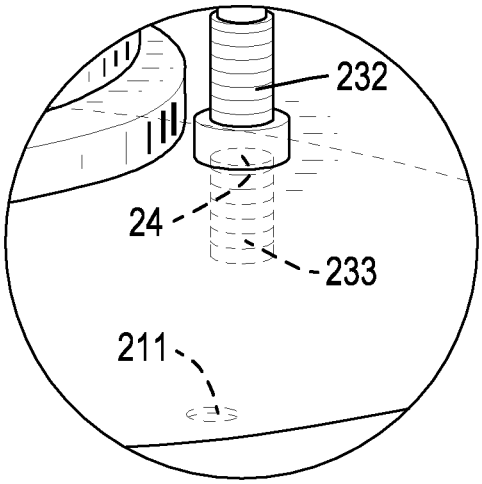
FIG. 2 is an enlarged perspective view of the drive assembly in FIG. 1.
Figure 3:
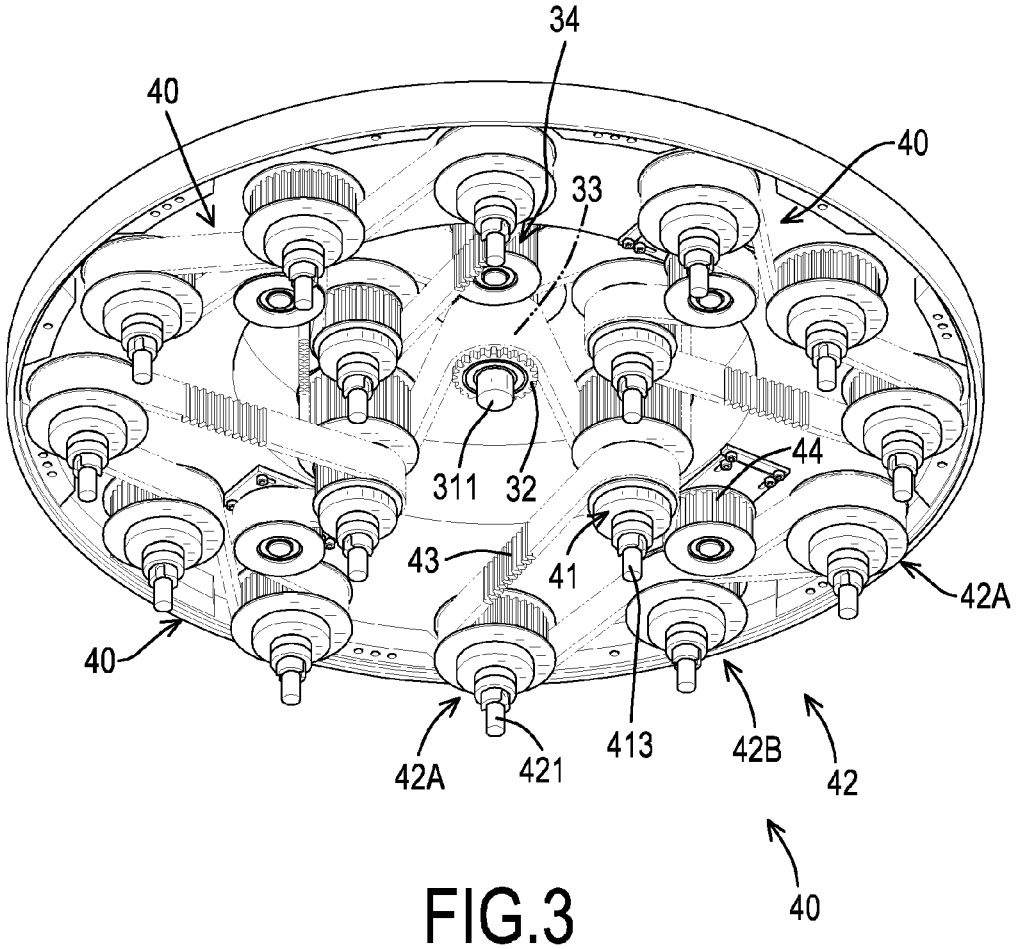
FIG. 3 is a perspective view of the drive assembly for a grinder in FIG. 1, wherein an outer housing and a lower cover are removed.

With reference to FIGS. 1 to 3, a first embodiment of a drive assembly for a grinder in accordance with the present invention is mounted on a body 10 and comprises a housing device 20, a drive device 30, multiple transmission devices 40 and multiple grinding devices 50.

The body 10 may be conventional and detailed description is omitted.

With reference to FIGS. 1, 2, 3 and 9, the housing device 20 is mounted securely on a bottom of the body 10. Preferably, the housing device 20 has an outer housing 20A and an inner housing 20B. The outer housing 20A has a top and two threaded holes 24. The threaded holes 24 are formed through the top of the outer housing 20A.

The inner housing 20B is rotatably mounted in the outer housing 20A and has a round upper cover 21, a round lower cover 22 and two positioning bolts 23. The upper cover 21 has a top and two cover holes 211. The cover holes 211 are respectively located at and formed through two opposite sides of the top of the upper cover 21 and respectively align with the threaded holes 24.

The lower cover 22 is connected with the upper cover 21.

Figure 8:
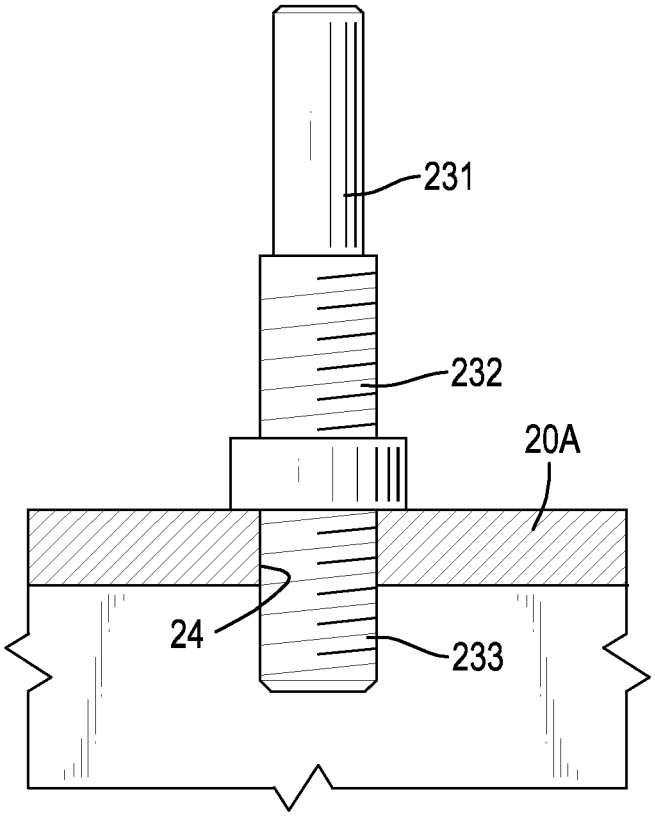
FIG. 8 is an enlarged side view in partial section of the drive assembly for a grinder in FIG. 1.
Figure 9:
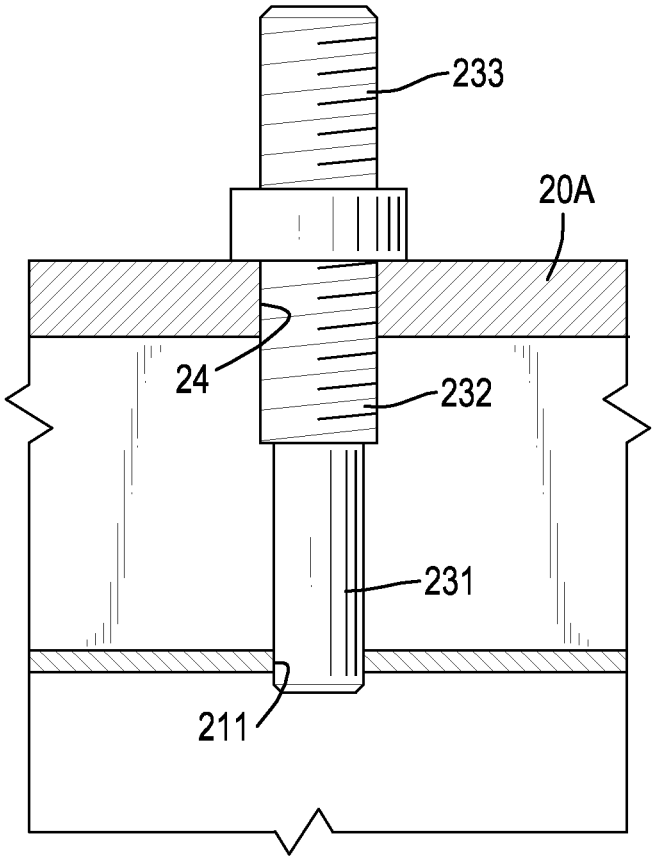
FIG. 9 is an operational side view in partial section of the drive assembly for a grinder in FIG. 8, showing a positioning bolt is inserted into a cover hole.

With reference to FIG. 8, the positioning bolts 23 are respectively and detachably mounted through the threaded holes 24 and are respectively inserted into the cover holes 211. Each positioning bolt 23 in turn has an inserted rod 231, a first threaded surface 232 and a second threaded surface 233. The inserted rod 231 of each positioning bolt 23 is detachably inserted into the cover hole 211 as shown in FIG. 9. The first threaded surface 232 and the second threaded surface 233 of each positioning bolt 23 are selectively screwed with the threaded holes 24.

With reference to FIG. 8, the second threaded surface 233 of each positioning bolt 23 is screwed into the threaded hole 24 and the inserted rod 231 of the positioning bolt 23 is located outside the outer housing 20A. Consequently, the inner housing 20B is disconnected from the outer housing 20A when the drive assembly does not operate or when the inner housing 20B rotates under its own inertia. Accordingly, dust can be prevented from entering the housing device 20 via the threaded holes 24 and the positioning bolts 23 can be prevented from being lost.

On the contrary, when the positioning bolts 23 are turned upside down, the inserted rods 231 are respectively inserted into the cover holes 211 and the first threaded surfaces 232 are respectively screwed into the threaded holes 24. Therefore, the outer housing 20A is rotated simultaneously with the inner housing 20B via the positioning bolts 23. With the positioning bolts 23 selectively inserted into the cover holes 211, the drive assembly has different grinding modes to be applied to different grounds.

Figure 5:
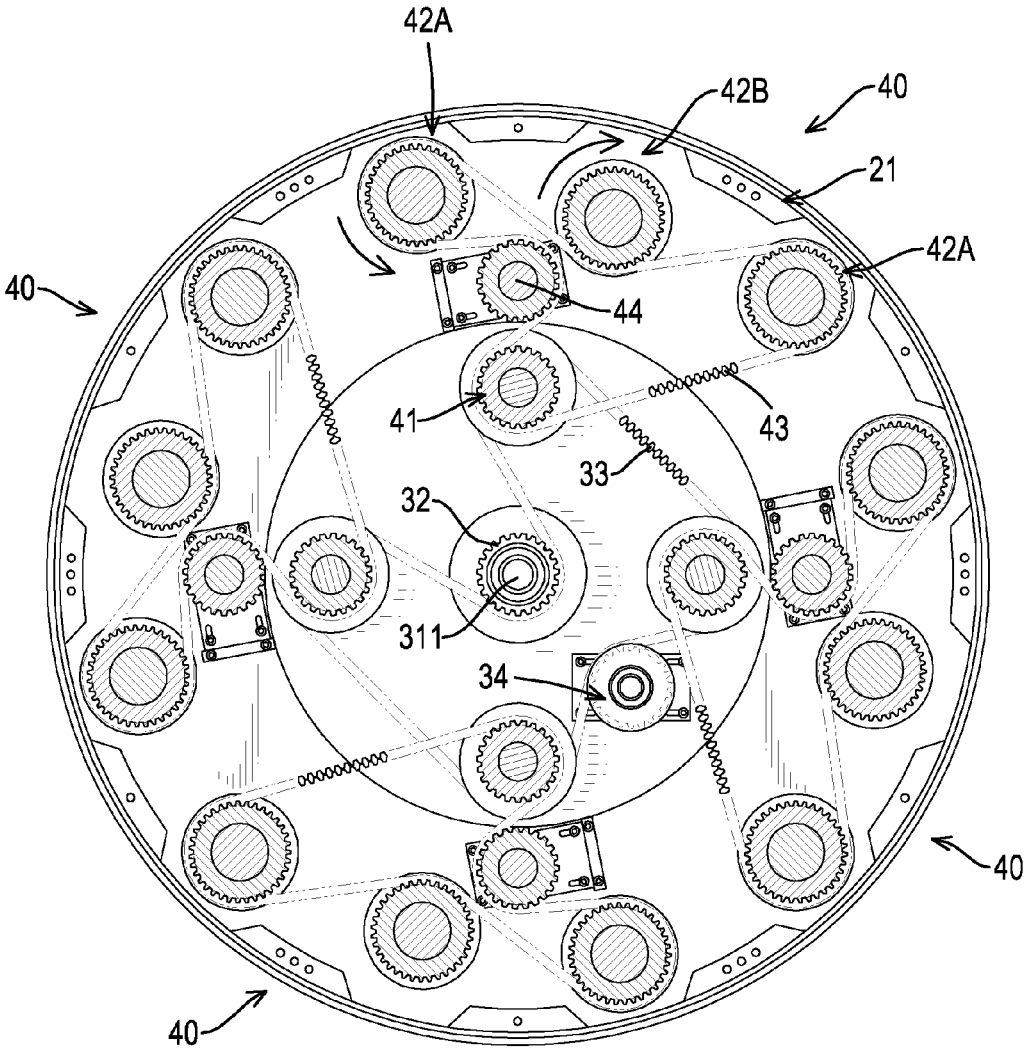
FIG. 5 is a side view in partial section of the drive assembly for a grinder in FIG. 3.
Figure 6:
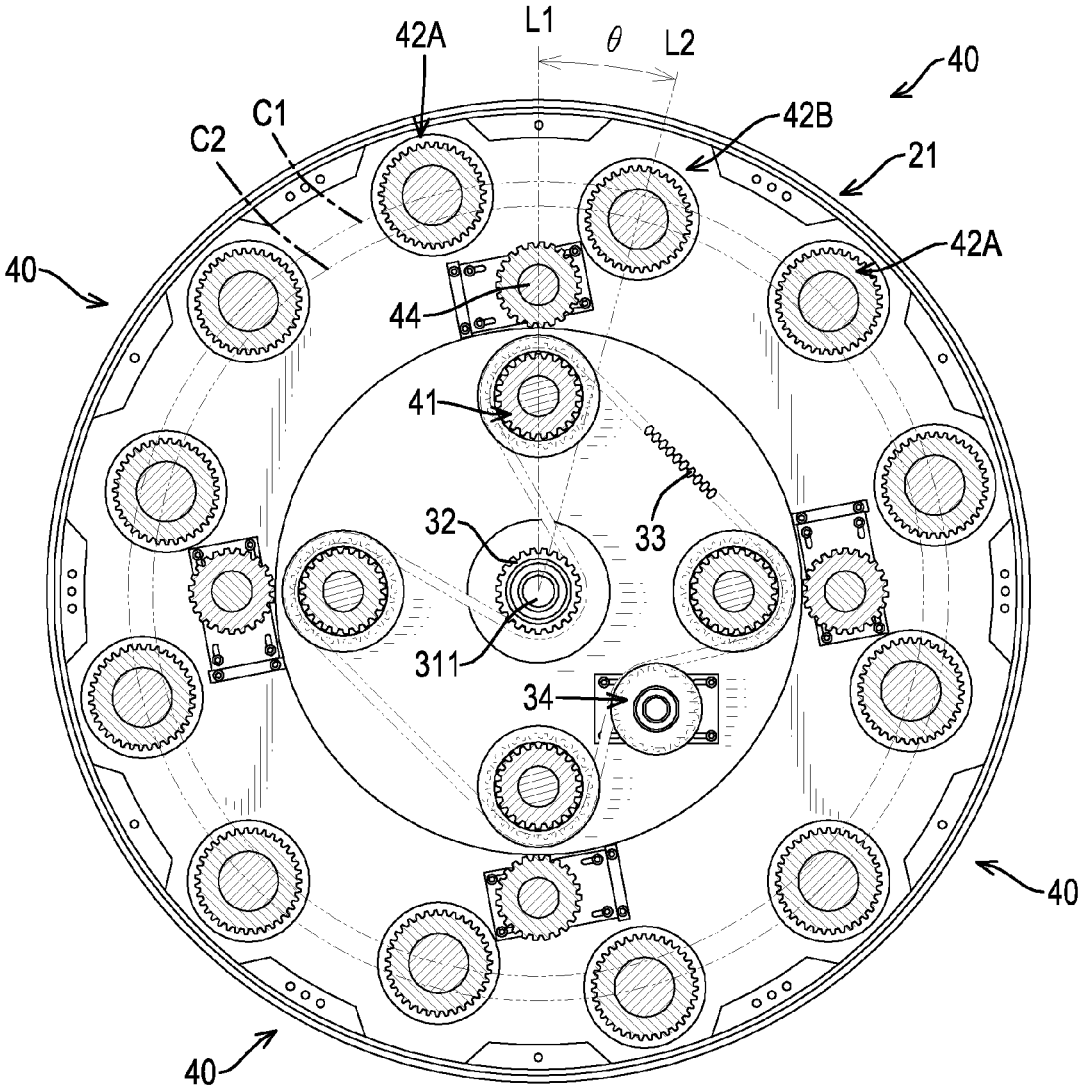
FIG. 6 is a side view in partial section of the drive assembly for a grinder in FIG. 5, wherein transmission bands are removed.

With reference to FIGS. 1, 5 and 6, the drive device 30 has a motor 31, a driving wheel 32, a driving band 33 and a band wheel 34.

The motor 31 is mounted securely on the top of the housing device 20 and has a rotatable shaft 311 mounted through the upper cover 21.

The driving wheel 32 is mounted in the housing device 20 and is securely mounted around the shaft 311 of the motor 31.

The driving band 33 is a belt, is engaged with the driving wheel 32 and has an inner surface and an outer surface. Accordingly, the driving wheel 32 and the driving band 33 can be rotated when the shaft 311 is rotated. Additionally, the driving band 33 may be a chain and the driving wheel 32 may be a gear.

The band wheel 34 is rotatably connected with the upper cover 21, is engaged with the outer surface of the driving band 33 and is capable of being slid to tighten or loosen the driving band 33.

Figure 4:
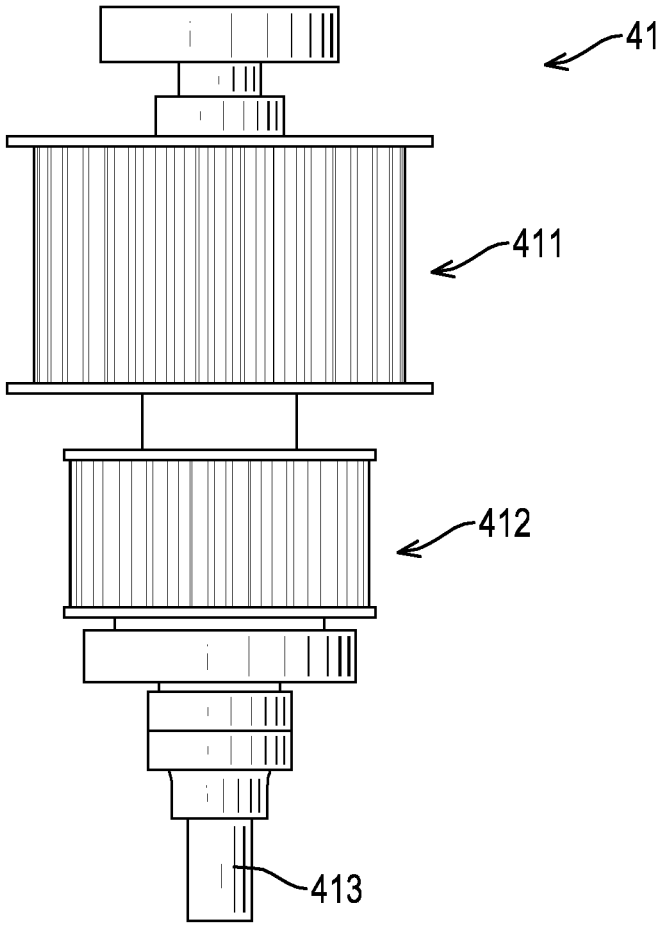
FIG. 4 is an enlarged side view of a transmission wheel of the drive assembly for a grinder in FIG. 1.

With reference to FIGS. 3 to 5, the transmission devices 40 are rotatably mounted in the housing device 20. Each transmission device 40 has a transmission wheel 41, multiple driven wheels 42, a transmission band 43 and an adjusting wheel 44.

Preferably, four transmission devices 40 are implemented.

Each transmission wheel 41 is engaged with the driving band 33. Preferably, the inner surface of the driving band 33 is engaged with outer surfaces of the transmission wheels 41. The outer surface of the driving band 33 is engaged with that of the driving wheel 32. Consequently, the rotated driving band 33 can drive the transmission wheels 41 to rotate.

With reference to FIG. 4, preferably, each transmission wheel 41 has a first toothed surface 411 and a second toothed surface 412. Each first toothed surface 411 is engaged with the driving band 33 and has multiple teeth. Each second toothed surface 412 has multiple teeth. The teeth of each first toothed surface 411 outnumber those of the second toothed surface 412. Each transmission wheel 41 has an axle 413 mounted through the bottom of the housing device 20. The difference in teeth number between the first toothed surface 411 and the second toothed surface 412 has a rotational speed reduction effect.

Each driven wheel 42 has an axial rod 421 mounted through the bottom of the housing device 20.

The transmission band 43 of each transmission device 40 is located below the driving band 33 and is engaged with the transmission wheel 41 and the driven wheels 42 of the transmission device 40. Preferably, three driven wheels 42 of each transmission device 40 are implemented and are defined as two first wheels 42A and a second wheel 42B. The second wheel 42B of each transmission device 40 is located between the first wheels 42A of the transmission device 40.

Each transmission band 43 has an inner surface and an outer surface. The inner surface of the transmission band 43 of each transmission device 40 is engaged with the first wheels 42A and the transmission wheel 41 of the transmission device 40. The outer surface of the transmission band 43 of each transmission device 40 is engaged with the second wheel 42B of the transmission device 40. Accordingly, rotational direction of each first wheel 42A is different from that of each second wheel 42B. Consequently, a surface of a work piece, stone for example, can be grinded with two different directions to have a great grinding effect.

With further reference to FIG. 6, preferably, an axis of each second wheel 42B is closer to an axis of the driving wheel 32 than an axis of each first wheel 42A is. With different distances from the driving wheel 32, a grinding area can be increased.

The transmission wheels 41 are arranged along a circumference at equal intervals. The second wheels 42B are arranged along a circumference C2 at equal intervals. The first wheels 42A are arranged along a circumference C1 at intervals. A line where an axis of each transmission wheel 41 and the axis of the driving wheel 32 are located is defined as a first line L1. A line where the axis of each second wheel 42B and the axis of the driving wheel 32 are located is defined as a second line L2. An angle between each first line L1 and one of the second lines L2 closest to the first line L1 is 15° (degree). Because the transmission wheels 41, the first wheels 42A and the second wheels 42B are distributed evenly, the drive assembly can grind quite evenly.

The adjusting wheel 44 of each transmission device 40 is rotatably connected with the upper cover 21, is engaged the outer surface of the transmission band 43 of the transmission device 40 and is capable of being slid to tighten or loosen the transmission band 43.

Figure 7:
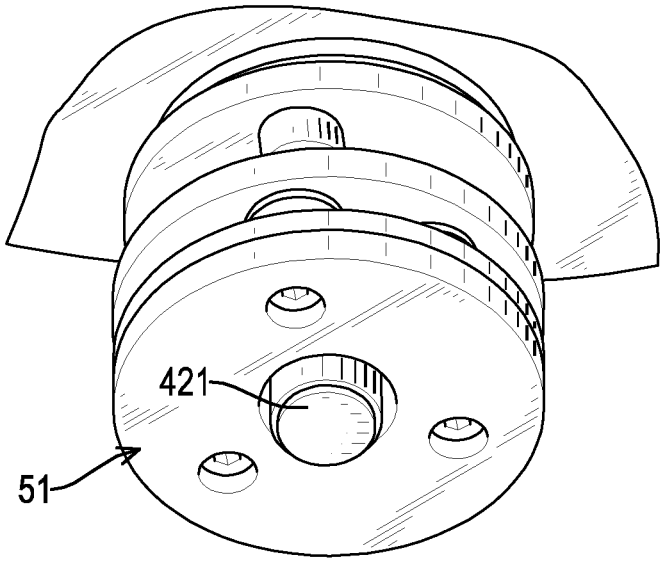
FIG. 7 is an enlarged perspective view of a grinding wheel of the drive assembly for a grinder in FIG. 1.

With reference to FIGS. 1 and 7, the grinding devices 50 are mounted outside the bottom of the housing device 20 and are respectively connected with the transmission devices 40. Each grinding device 50 has multiple grinding wheels 51 respectively and securely mounted around the axial rods 421 and the axles 413.

Figure 10:
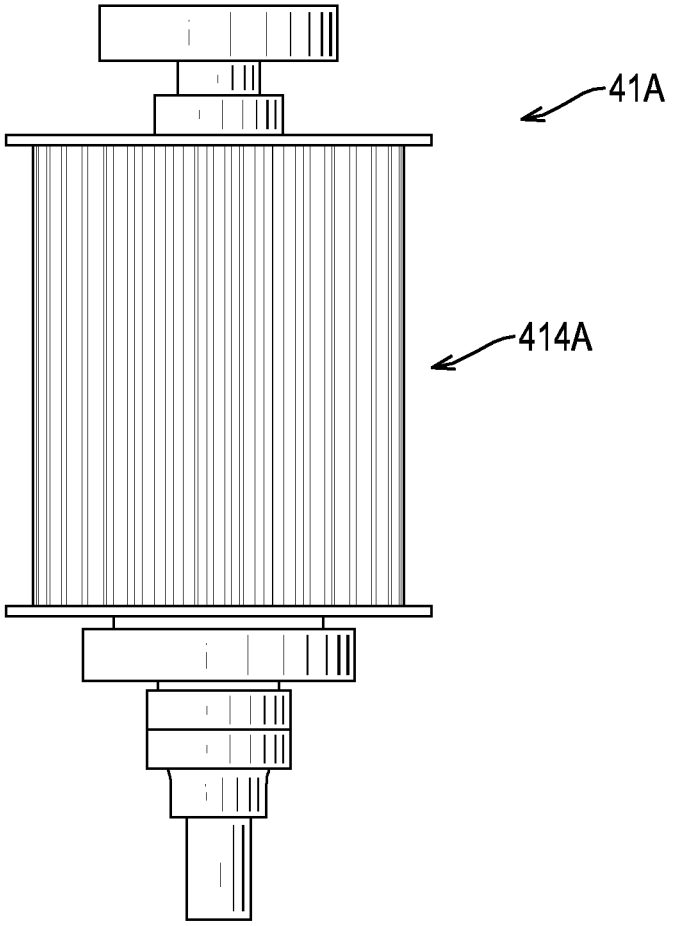
FIG. 10 is an enlarged side view of a transmission wheel of a second embodiment of the drive assembly for a grinder in accordance with the present invention.

With reference to FIG. 10, a second embodiment of the drive assembly for a grinder is substantially the same as the first embodiment except the transmission wheel 41A of each transmission device 40 has a third toothed surface 414A engaged the driving band 33 and the transmission band 43 of the transmission device 40 as shown in FIG. 5.

From the above description, it is noted that the present invention has the following advantages:

1. Reducing Load of the Motor 31:

With two-layer arrangement of the bands, the driving band 33 and the transmission bands 43 are not long and can be rotated smoothly to reduce energy waste. Accordingly, the load of the motor 31 is greatly reduced, lifespans of the driving band 33 and the transmission bands 43 are prolonged and maintenance expense is reduced.

2. Great Grinding Effect:

Because the rotational direction of each first wheel 42A is different from that of each second wheel 42B, a work piece can be grinded with two opposite directions and a great grinding effect is enhanced.

3. Enlarged Grinding Area:

The second wheels 42B and the first wheels 42A are located at different circumferences C1,C2, so the grinding area is increased.

4. Application to Different Grounds:

Because the positioning bolts 23 are selectively inserted into the cover holes 211, different grinding modes of the drive assembly can be applied to different grounds and this is greatly useful. Moreover, the positioning bolts 23 can be prevented from being lost and dust is also prevented from entering the housing device 20.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drive assembly for a grinder comprising:

a housing device having a top and a bottom;

a drive device connected with the housing device and having a motor mounted securely on the top of the housing device and having a rotatable shaft mounted through the top of the housing device;

a driving wheel mounted in the housing device and securely mounted around the shaft of the motor; and a driving band engaged with the driving wheel;

multiple transmission devices rotatably mounted in the housing device, each transmission device having a transmission wheel engaged with the driving band;

multiple driven wheels, each driven wheel having an axial rod mounted through the bottom of the housing device; and a transmission band engaged with the transmission wheel and the driven wheels; and multiple grinding devices mounted outside the bottom of the housing device and respectively connected with the transmission devices, each grinding device having multiple grinding wheels respectively and securely mounted around the axial rods of the transmission devices.

2. The drive assembly for a grinder as claimed in claim 1, wherein the transmission wheel of each transmission device has a first toothed surface engaged with the driving band and having multiple teeth; and a second toothed surface engaged with the transmission band of the transmission device and having multiple teeth, wherein the teeth of the first toothed surface outnumber those of the second toothed surface.

3. The drive assembly for a grinder as claimed in claim 2, wherein three driven wheels of each transmission device are implemented and are defined as two first wheels; and a second wheel located between the first wheels, wherein an axis of each second wheel is closer to an axis of the driving wheel than an axis of each first wheel is.

4. The drive assembly for a grinder as claimed in claim 3, wherein the driving band has an inner surface engaged with outer surfaces of the transmission wheels; and an outer surface engaged with that of the driving wheel; and the transmission band of each transmission device has an inner surface engaged with the first wheels and the transmission wheel of the transmission device; and an outer surface engaged with the second wheel of the transmission device.

5. The drive assembly for a grinder as claimed in claim 4, wherein the transmission wheels are arranged along a circumference at equal intervals;

the second wheels are arranged along a circumference at equal intervals;

the first wheels are arranged along a circumference at equal intervals;

a line where an axis of each transmission wheel and the axis of the driving wheel are located is defined as a first line;

a line where the axis of each second wheel and the axis of the driving wheel are located is defined as a second line; and an angle between the first line and the second line is 15° (degree).

6. The drive assembly for a grinder as claimed in claim 5, wherein each transmission wheel has an axle mounted through the bottom of the housing device; and one of the grinding wheels of each grinding device is securely mounted around the axle of each transmission wheel of the transmission device.

7. The drive assembly for a grinder as claimed in claim 6, wherein the drive assembly has four transmission devices rotatably mounted in the housing device.

8. The drive assembly for a grinder as claimed in claim 7, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

9. The drive assembly for a grinder as claimed in claim 6, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

10. The drive assembly for a grinder as claimed in claim 5, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

11. The drive assembly for a grinder as claimed in claim 4, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

12. The drive assembly for a grinder as claimed in claim 3, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

13. The drive assembly for a grinder as claimed in claim 2, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

14. The drive assembly for a grinder as claimed in claim 1, wherein the housing device has an outer housing having a top; and a threaded hole formed through the top of the outer housing;

an inner housing rotatably mounted in the outer housing and having an upper cover having a top; and a cover hole formed through the top of the upper cover and aligning with the threaded hole of the outer housing;

a lower cover connected with the upper cover; and a positioning bolt detachably connected with the threaded hole and the cover hole and in turn having an inserted rod detachably inserted into the cover hole;

a first threaded surface; and a second threaded surface, wherein the first threaded surface and the second threaded surface are selectively screwed with the threaded hole.

15. The drive assembly for a grinder as claimed in claim 1, wherein the transmission wheel of each transmission device has a third toothed surface engaged with the driving band and the transmission band of the transmission device.

* * * * *